United States Patent [19]

Wessels

[11] Patent Number: 4,587,827

[45] Date of Patent: May 13, 1986

[54] METHOD OF SHEET METAL PROCESSING

[76] Inventor: Ewald J. H. Wessels, Van Rheede, Alexandra Road, Wynberg 7700, South Africa

[21] Appl. No.: 725,113

[22] Filed: Apr. 19, 1985

[30] Foreign Application Priority Data

Aug. 7, 1984 [ZA] South Africa ..... 84/6126

[51] Int. Cl.[4] ..... B21D 22/00

[52] U.S. Cl. ..... 72/349; 72/348

[58] Field of Search ..... 72/347–349, 72/350, 351, 336

[56] References Cited

U.S. PATENT DOCUMENTS

| | | | |
|---|---|---|---|
| 444,918 | 1/1891 | Mason et al. . | |
| 1,187,461 | 6/1916 | Knox . | |
| 1,412,785 | 4/1922 | Jernberg . | |
| 1,580,931 | 4/1926 | Thackray . | |
| 2,270,185 | 1/1942 | Dulmage . | |
| 2,518,483 | 8/1950 | Mopes | 72/349 |
| 2,600,834 | 6/1952 | Blair . | |
| 2,602,411 | 7/1952 | Schnell | 72/349 |
| 3,263,637 | 8/1966 | Cox | 72/349 |
| 3,299,689 | 1/1967 | Dolney | 72/350 |
| 3,704,618 | 12/1972 | Cuacho | 72/336 |
| 3,918,377 | 11/1975 | Herbold | 72/350 |
| 4,185,488 | 1/1980 | Miller | 72/350 |

FOREIGN PATENT DOCUMENTS 883735 7/1953 Fed. Rep. of Germany .

*Primary Examiner*—Leon Gilden

*Attorney, Agent, or Firm*—Larson and Taylor

[57] ABSTRACT

A method of drawing metal cups from metal sheets, which includes the steps of separating non-circular blanks of material from a metal sheet and of drawing cups from such blanks. The blanks may be of substantially hexagonal or square shape.

6 Claims, 6 Drawing Figures

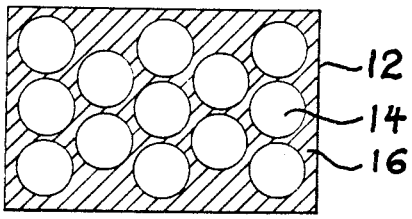
FIG. 1
FIG. 2
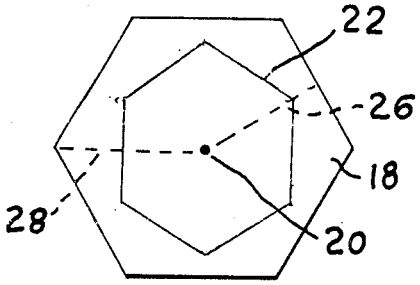
FIG. 3
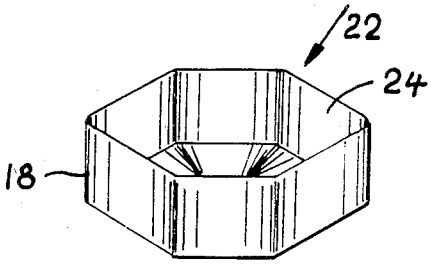
FIG. 4
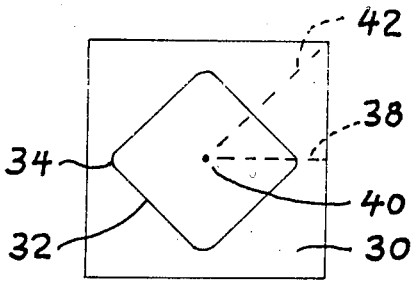
FIG. 5
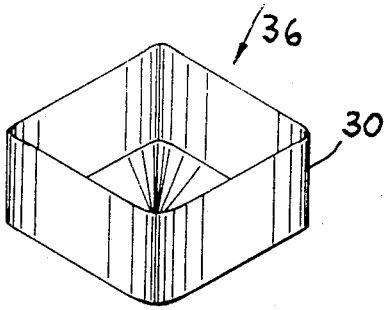

METHOD OF SHEET METAL PROCESSING

FIELD OF INVENTION

The present invention relates to a method of metal sheet processing.

More particularly, the invention relates to metal sheet drawing.

BACKGROUND TO INVENTION

The technology is known for drawing cylindrical metal cups from metal sheets. Such cups are, for example, the cups from which drawn metal caps and drawn and wall-ironed metal cans are made.

Conventionally these cups are drawn from circular disc-shaped blanks, which are cut out from a metal sheet leaving "a waste skeleton". This waste is of no further use and is normally sold as scrap material.

It is an object of the invention to suggest a method of drawing metal cups, which will utilize the sheet material more efficiently.

SUMMARY OF INVENTION

According to the invention, a method of drawing metal cups from metal sheets includes the steps of separating non-circular blanks of material from a metal sheet and of drawing cups from such blanks.

The blanks may be cut or punched from the metal sheet.

The invention also extends to a non-circular metal sheet blank punched or cut from a metal sheet.

The blanks may be hexagonal, or square or substantially hexagonal or substantially square so as to provide for better utilization of the overall area of the metal sheet and to cause a relatively reduced portion of the sheet to be left as "waste skeleton".

The method in accordance with the invention further includes the step of drawing a non-circular cup from the non-circular blank such a way in that more stretching takes place in those areas of the blank where the perimeter is closer to the geometrical centre of the blank than the stretching which takes place in those areas of the blank where the perimeter is further away from the geometrical centre of the blank.

BRIEF DESCRIPTION OF DRAWINGS

The invention will now be described by way of example with reference to the accompanying schematic drawings.

In the drawings there is shown in

FIG. 1 a plan view of a metal sheet from which the conventional round circular blanks have been cut or punched;

FIG. 2 on a larger scale a plan view of a cup blank in accordance with the invention;

FIG. 3 a pictorial view of a cup formed from a cup blank as illustrated in FIG. 2;

FIG. 4 a plan view of a second embodiment of a cup blank in accordance with the invention; and FIG. 5 a pictorial view of a cup formed from a cup blank as illustrated in FIG. 4.

DETAILED DESCRIPTION OF DRAWINGS

Figure 6:
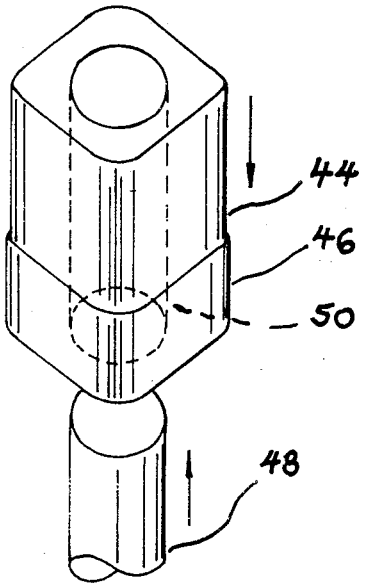
FIG. 6 a pictorial view of an alternative method of forming a cup.

Referring to FIG. 1 a conventional sheet of metal 12 is shown from which round circular cup blanks 14 have been punched. The remainder or waste skeleton material 16 is normally disposed of as scrap material.

Due to the geometric area covered, a circular blank 14 causes a large portion of the sheet 12 to be wasted.

Referring now to FIG. 2, in accordance with the invention, a non-circular cup blank 18 is to be cut from a sheet of metal. This cup blank as illustrated is of hexagonal shape and has a geometric centre 20. The eventual cross-section of the cup to be shaped therefrom is indicated by reference numeral 22.

In FIG. 3 the cup 22, as shaped from the cup blank 18 is illustrated. In shaping such a cup the wall 24 is stretched more in those parts where the blank perimeter was closer to the geometric centre 20 of the blank (reference numeral 26 in FIG. 2) than those parts where the blank perimeter was further away (reference numeral 28 in FIG. 2).

FIG. 4 shows a further embodiment where a square blank 30 is punched from a sheet of material. Here the cup will have a shape 32 as shown with rounded corners 34. Once again during the formation of the cup 36 the material in those parts of the blank 38, where the blank perimeter was closer to the geometric centre 40, is stretched more than the material in those parts 42, which are further away from the centre 40.

In both examples illustrated in FIGS. 2 to 5 the shape of the blank results in a better utilization of the sheet material. In fact in the case of the example illustrated in FIGS. 4 and 5 there should be no waste material left.

In both the examples illustrated the straight sections of the cross-section of the cups may alternatively be curved, either inwardly towards the geometrical centre of the blank, or outwardly toward the perimeter of the blank.

Referring to FIG. 6 the method in accordance with the invention may also include the steps of drawing a circular cup from the non-circular cup by a further draw or reverse draw. This final step may be preceded by one or more intermediate stages during which one or more circular or non-circular cups of smaller cross-sectional area than that of the original non-circular cup are drawn or reverse-drawn as shown in FIG. 6. For this purpose a non-circular punch 44 in a first step forms a non-circular cup 46 and by way of forming the cup 46 into the circular reverse-draw die 50 forms a circular cup.

I claim:

1. A method of drawing a circular metal cup from a metal sheet, comprising providing a non-circular blank from a metal sheet, drawing, in at least one drawing step, a non-circular cup from the non-circular blank in such a way that more stretching takes place in those areas of the blank where the perimeter is closer to the geometrical center of the blank than the stretching which takes place in those areas of the blank where the perimeter is further away from the geometrical center of the blank, and drawing a circular cup from the non-circular cup.

2. A method as claimed in claim 1, in which the blank is cut from the metal sheet.

3. A method as claimed in claim 1, in which the blank is punched from the metal sheet.

4. A method as claimed in claim 1, in which the blank is of substantially hexagonal shape.

5. A method as claimed in claim 1, in which the blank is of substantially square shape.

6. A method as claimed in claim 1, in which said drawing of said non-circular cup comprises a plurality of drawing steps.

* * * * *